US012181233B2

(12) United States Patent
de Graffenried

(10) Patent No.: US 12,181,233 B2
(45) Date of Patent: Dec. 31, 2024

(54) GAS SHELL AND GAS-FILLED BARREL TO INCREASE EXIT VELOCITY OF A PROJECTILE

(71) Applicant: Christopher L. de Graffenried, Mahopac, NY (US)

(72) Inventor: Christopher L. de Graffenried, Mahopac, NY (US)

( * ) Notice: Subject to any disclaimer, the term of this patent is extended or adjusted under 35 U.S.C. 154(b) by 0 days.

(21) Appl. No.: 17/981,485

(22) Filed: Nov. 7, 2022

(65) Prior Publication Data

US 2024/0133645 A1 Apr. 25, 2024

Related U.S. Application Data

(60) Provisional application No. 63/276,219, filed on Nov. 5, 2021.

(51) Int. Cl.
*F41A 1/04* (2006.01)
*F41A 13/00* (2006.01)

(52) U.S. Cl.
CPC ..... *F41A 1/04* (2013.01); *F41A 13/00* (2013.01)

(58) Field of Classification Search
CPC ..... F41A 1/04; F41A 13/04
See application file for complete search history.

(56) References Cited

U.S. PATENT DOCUMENTS

| | | | | |
|---|---|---|---|---|
| 3,425,316 | A * | 2/1969 | Egbert | F41F 3/04 89/1.818 |
| 5,703,322 | A | 12/1997 | Tidman | |
| 6,318,229 | B1 * | 11/2001 | Nevels | F41F 3/04 89/1.816 |
| 7,194,852 | B1 | 3/2007 | Krishnan | |
| 7,775,148 | B1 * | 8/2010 | McDermott | F41B 11/723 89/1.809 |
| 7,954,413 | B2 | 6/2011 | Koth | |
| 9,915,496 | B2 | 3/2018 | Bergeron | |
| 10,119,780 | B1 | 11/2018 | Bergeron | |

OTHER PUBLICATIONS

International Search Report and Written Opinion received in International Application No. PCT/US2022/049071, mailed on Jul. 17, 2023, 8 Pages.

* cited by examiner

*Primary Examiner* — Bret Hayes
(74) *Attorney, Agent, or Firm* — Gearhart Law, LLC

(57) ABSTRACT

Air as conventionally known is comprised of about 78% nitrogen and 21% oxygen with other trace gases such as carbon dioxide, neon, and hydrogen. Other gases (e.g. helium) and partial vacuums have both a lower density and a higher speed-of-sound from that of conventional air or even some highly utilized propellant gases. The present application and described embodiments take advantage of these principles to provide a purge gas mixture and system to increase the speed of a projectile exiting the muzzle-end of a gun barrel. A partial vacuum may also be used in certain applications.

20 Claims, 6 Drawing Sheets

GAS SHELL AND GAS-FILLED BARREL TO INCREASE EXIT VELOCITY OF A PROJECTILE

CLAIM OF PRIORITY

This application is a Non-Provisional Application which claims priority to U.S. Provisional Patent Application No. 63/276,219 filed on Nov. 5, 2021, the contents of which are hereby incorporated by reference in their entirety.

FIELD OF THE EMBODIMENTS

This field of the embodiments of the present invention relates to apparatus, methods, processes, and designs for the enhancement of bullet or projectile speed exiting the muzzle-end of a barrel or projectile launcher. In particular, the present application and its embodiments are directed to reducing friction within a barrel or projectile launcher thereby increasing the exit velocity of the bullet or projectile.

BACKGROUND OF THE EMBODIMENTS

The exit velocity of a projectile from a weapon is a function of a number of factors, including but not limited to, propellant force and work (e.g., pressure, area, duration of burn), mass, resistance (friction, barrel twist, etc.), and barrel length. For many applications, increasing the exit velocity or muzzle speed, often expressed in ft./s or m/s, is desirable for the end user.

Additional resistance occurs when the projectile goes supersonic within the barrel. Gases "pile up" in front of the projectile (a shock wave), as these gases are swept out of the way of the faster projectile, limited to some degree by the speed of sound in the gases within the gun barrel or tube. If perhaps 2-3% of this wasted energy is made available for the projectile, it will increase the projectile's exit speed accordingly. This in turn suggests that all else being equal, the projectile may travel perhaps 2-3% farther, and/or deliver 2-3% more energy to the target at the same distance for kinetic projectiles.

Review of Related Technology

U.S. Pat. No. 7,954,413 pertains to an improved two-stage light gas gun for launching projectiles at high speeds. The gun consists of three tubes: the expansion, pump, and launch tubes. The expansion tube contains a close-fitting expansion piston that is propelled by an explosive charge. The expansion piston in turn drives the pump piston housed within the pump tube by means of a rod connecting the two pistons. The action of the pump piston adiabatically compresses and heats a light gas of hydrogen or helium, bursting a diaphragm at a predetermined pressure and expelling the projectile from the launch tube at a very high speed.

U.S. Pat. No. 9,915,496 pertains to an improved light gas gun launches a projectile in a light gas atmosphere as it travels through a frictionless barrel to achieve high muzzle velocities, decreased acoustic signatures, and increased ranges. The light gas atmosphere is introduced by a purge valve prior to firing or by a muzzle valve that holds a positive light gas pressure on the barrel and breech. The muzzle valve also routes the majority of propellant gases through a suppression canister, reducing the light gas gun's acoustic signature. The frictionless barrel uses light gas propellant routed through gas bearings to keep the projectile centered in the barrel and preclude the projectile from contacting the barrel walls, eliminating barrel wear.

U.S. Pat. No. 10,119,780 pertains to an improved light gas gun that launches a projectile in a light gas atmosphere as it travels through a frictionless barrel to achieve high muzzle velocities, decreased acoustic signatures, and increased ranges. The light gas atmosphere is introduced by a purge valve prior to firing or by a muzzle valve that holds a positive light gas pressure on the barrel and breech. The muzzle valve also routes the majority of propellant gases through a suppression canister, reducing the light gas gun's acoustic signature. The frictionless barrel uses light gas propellant routed through gas bearings to keep the projectile centered in the barrel and preclude the projectile from contacting the barrel walls, eliminating barrel wear. The system includes a projectile assembly that stores light gas from the firing and injects it into the boundary layer, reducing drag, increasing range and lethality, and decreasing the acoustic signature of the projectile downrange.

Various devices are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

The present application and its embodiments seek to improve the exit velocity or muzzle speed of a projectile launched therefrom. One embodiment of the present application is directed to (gun) barrel resistance. Within the set of resistance factors, we are concerned and focus narrowly on resistance coming from gases contained within the gun barrel or gun tube. These gases may include air and residual propellant gases. And resistance may also include that associated with the MACH number attained by the projectile while still accelerating within the gun barrel. For a large weapon, gun barrel gas-related mass can represent on the order of approximately 1% of the mass of the projectile itself. That is, the propellant gases put about 97% of their energy into accelerating the projectile, and about 3% of their energy into overcoming the choking effects of the projectile exceeding the speed of sound in the barrel gases, and accelerating the gases out of the gun barrel or gun tube muzzle-end. By purging the gun barrel and refilling it with lighter lubricating gases, especially those with a higher speed of sound, then the weapon may recapture even more of the propellant energy wasted in overcoming these resistance factors, thereby increasing the speed of the projectile as it exits the muzzle-end of the gun barrel or tube.

In one aspect, an apparatus for use for launching a projectile includes a trigger coupled to a firing mechanism, a breech for loading at least one projectile, with the breech holding a bullet or projectile, a barrel having a breech end and a muzzle end, a projectile having a propulsive charge and projectile body, and a purge apparatus configured to purge air and other gasses from an interior of the barrel thereby displacing and replacing the air and other gases with a purge gas, where the purge apparatus is activated before the launching of the projectile.

The apparatus may also include where the purge gas is at least one of helium, hydrogen, methane, or any combination thereof.

The apparatus may also include where the purge gas has a lower density and a higher speed of sound than the air and/or residual propellant gasses.

The apparatus may also include where, when the trigger of the apparatus is activated, a valve releases the purge gas into the interior of the barrel.

The apparatus may also include a vessel configured to store a fluid.

The apparatus may also include a membrane disposed over an opening of the barrel.

The apparatus may also include where the purge gas fully purges the interior of the barrel.

The apparatus may also include where the purge gas partially purges the interior of the barrel. Other technical features may be readily apparent to one skilled in the art from the following figures, descriptions, and claims.

The apparatus may also include where the water is converted to steam, and the steam is used to purge the air and/or residual propellant gasses from the barrel.

The apparatus may also include where the fluid is water.

In general, the present invention succeeds in conferring the following, and other not mentioned, benefits and objectives.

It is an object of the present invention to provide an apparatus for launching a projectile at increased velocities.

It is an object of the present invention to provide an apparatus for reducing the gaseous resistance with a barrel of a projectile launcher (e.g., a gun).

It is an object of the present invention to provide an apparatus for purging gases from within a barrel of a projectile launcher.

It is an object of the present invention to provide an apparatus for using steam to purge a barrel.

It is an object of the present invention to provide an apparatus for using helium, hydrogen, and/or methane to purge a barrel.

It is an object of the present invention to provide an apparatus that has a protective membrane, star flap, or foil at an end of the barrel.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DESCRIPTION OF THE PREFERRED EMBODIMENTS

Figure 1:
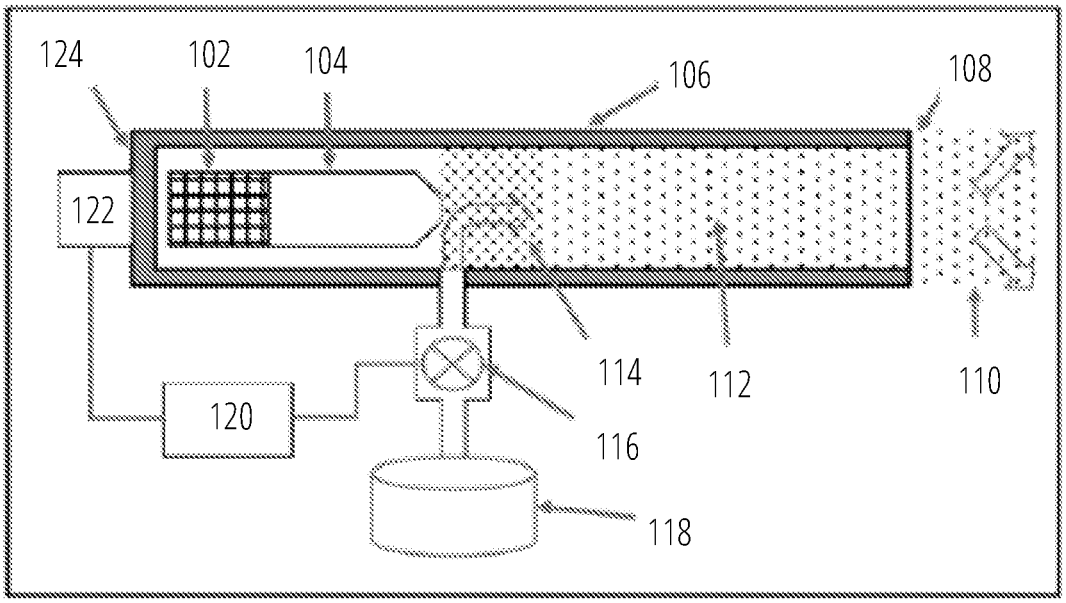
FIG. 1 illustrates an aspect of the subject matter in accordance with one embodiment.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As shown in FIG. 1, the system comprises at least a charge 102, a projectile 104, a barrel 106, a muzzle 108, an exit air 110, an internal air 112, a purge gas 114, an HP (high-pressure purge) valve 116, a purge gas storage tank 118, a trigger 120, a firing mechanism 122, and a breech 124.

Here, the HP valve 116 is positioned such that the purge gas 114 is introduced in front of the projectile 104 to remove or purge the internal air 112 (which may comprise any residual propellant gases from previous firings as well as any other gases present within the barrel interior environment) from the barrel 106 of the system. Once purged, the speed or velocity of the projectile 104 will increase due to the presence of the lower-resistance purge gas 114 and the lack of the internal air 112. The trigger 120 can be activated (e.g. depressed) which in turn causes the firing mechanism 122 to interact with the projectile 104 causing the projectile 104 to be expelled from the barrel 106.

In general, a projectile weapon is a system for delivering maximum destructive momentum and energy to the target with a minimum delivery of recoil momentum and energy to the shooter or firing platform. The momentum and energy delivered to the target is less than that associated with recoil impacting the shooter or firing platform due to inefficiencies, including friction and losses, inherent to the weapon as an energy and momentum delivery system, as formed by the gun, propellant, projectile 104, barrel 106, the shooter or firing platform, and any air resistance between the breech 124 of the gun and the target. This is due to laws of conservation of energy and momentum, which dictate that the energy and momentum imparted to the bullet or projectile as it exits the muzzle-end of the gun is equal and opposite to that imparted to the gun-shooter system.

This application and its embodiments recognize that air or residual propellant gases located inside a barrel 106 represent one of the inefficiencies in the gun system which impedes the movement of the bullet or projectile 104 within the barrel 106, and, therefore, reduces the speed of the bullet or projectile 104 at the point of exiting the muzzle 108 of the gun barrel 106. By replacing the internal air 112 or propellant residual gasses in the gun barrel 106 with a purge gas 114 (e.g., steam) with a higher speed of sound and/or lower density, then the bullet or projectile 104 reaches a higher exit velocity for any given barrel length, mass, and propellant charge.

In a sense, a firearm can be thought of a special type of piston engine, or heat engine where the bullet or projectile 104 serves as a one-directional piston. Air or propellant residual gases located inside a gun barrel 106 must be pushed out of the way by the bullet or projectile 104. Ejecting this air or these residual propellant gasses from the barrel 106 absorbs energy that might otherwise be imparted to the bullet or projectile. Longer barrels 106 must eject a longer column of gasses before the projectile 104, absorbing energy from the propellant that could otherwise go into the speed of the projectile 104. By reducing this energy loss, more of the propellant energy is available for transfer to the projectile 104, and less is put into ejecting the long air column, or column of residual propellant gasses. The laws of conservation of momentum and energy state that the momentum imparted to the bullet or projectile may not exceed that imparted to recoil:

$m_b \cdot v_b < M_g \cdot V_g$, where

The product of $m_b$ and $v_b$ are the momentum imparted to the bullet or projectile 104, and The product of $M_g$ and $V_g$ represents the momentum imparted to recoil of the weapon.

The difference in large part represents momentum imparted to the air or residual gasses in the barrel in ejecting them from the barrel 106 in advance of the bullet or projectile 104.

$m_b \cdot v_b + m_a \cdot v_a + F = M_g \cdot V_g$, where

The product of $m_a$ and $v_a$ represents momentum imparted to the internal air 112 or residual gasses in the barrel 106. The term F represents other resistance, e.g., friction.

Air, in general, has a density of approximately 1.225 kg/m$^3$. Density is affected not only by temperature and pressure, but also by the amount of water vapor contained in the air.

EXAMPLES

Example 1: The Ruger Model 44 carbine with lever-action and autoloading and chambered with .44 Mag., for whitetail deer and black bear where shots are close.

The bullet exits the muzzle-end of the weapon at approximately 1,180 feet per second (360 m/s). The inner diameter of the barrel and outer diameter of the bullet is approximately 0.429 in. (10.9 mm or 0.0109 m), the radius is one-half or approximately 0.00545 meters, and it has a barrel length of 18.25 in (464 mm or 0.464 m). The volume of air sitting in the barrel (a right cylinder) is therefore $\text{Vol.} = (\pi r^2) \cdot h$, where The volume (Vol.) is equal to the constant pi ($\pi$=3.1415926) multiplied by the square of the radius of the barrel, times the height of that right cylinder.

$\text{Vol.} = 3.1415926 \cdot (0.00545\ \text{m})^2 \cdot 0.464\ \text{m} = 4.33\text{e-}5\ \text{m}^3$ Air has a density of approximately 1.225 kg/m. (Density is affected not only by temperature and pressure, but also by the amount of water vapor contained in the air.)

Multiplying the barrel volume (Vol.) by this density produces a mass of about 5.3e-5 kg or 5.3e-2 grams. The bullet weighs 0.016 kg. So, the air weighs approximately 0.3% of the mass of the bullet. The momentum imparted to this air, ejected from the muzzle-end of the barrel at about 360 m/s, is approximately 0.019 kg-m/s. The momentum imparted to the bullet is about 0.016*360=5.76 kg-m/s.

At the same speed, the momentum is 0.3% of the momentum imparted to the bullet, assuming subsonic conditions, without choking effects.

The speed of sound through air is approximately 343 m/s at normal room temperature, which is at 20° C. The speed of sound in air is approximately figured out by the formula: speed of sound (m/s)=331.5+0.60 T (° C.)

So, the .44 Mag exiting the Ruger Model 44 carbine is traveling slightly supersonic at MACH 1.05 exiting the muzzle-end of the barrel. As a result, some supersonic wavefront effects (choking) may also impede the exit of the bullet from the barrel.

However, if the barrel of the Ruger Model 44 carbine were purged with Helium the bullet would be subsonic within the barrel and would become supersonic only after exiting the barrel. Why? Because the speed of sound in Helium is 1,007 m/s, well above that of air at 343 m/s. So, the effects of supersonic waves within the barrel would be nonexistent. If you were seeking to accelerate a projectile to a higher velocity, then Helium would accept projectile speeds of nearly triple (1007/343=2.94) those of air before becoming supersonic in-barrel. The speed of sound in Hydrogen is 1,270 m/s, and that of Steam, depending upon its temperature, is over 500 m/s.

Whereas the speed of sound in carbon dioxide ($CO_2$), a common by-product of the propellant charge, is about 267 m/s or about 78% that of air, or only 27% of that of Helium.

Example 2: The M110 SASS (Semi-Automatic Sniper System) is an American semi-automatic sniper rifle/designated marksman rifle using a 7.62×51 mm NATO round. It has a Muzzle velocity of 783 m/s (2,570 ft/s) with 175 gr. (11 g) M118LR round, bullet diameter 0.308 in. (7.82 mm). A commercial 0.308 round will also fire with a bullet diameter 0.308 in. (7.8 mm). The radius is about 7.8/2=3.9 mm or 0.0039 m. The gun barrel on the M110 is 508 mm (20 in) or 0.508 m. The Vol.=($\pi$ r$^2$)·h volume of air swept out of the barrel when firing is about 2.43e-5 m$^3$. Air has a density of approximately 1.225 kg/m$^3$. So, we are seeing a mass of air equal to 3.0e-5 kg. Again about 0.3% of the bullet mass. The mass of the bullet is 11 g or 0.011 kg.

Yet, the round is moving at approximately twice the speed of the prior Example 1 projectile (343 vs. 783 m/s). So, the momentum imparted to the air is approximately 0.023 kg-m/s or about 23% more than in Example 1 above. Also, the air and bullet are moving at MACH 2.3 at the muzzle-end of the barrel. Supersonic choking effects in the barrel are evident. If Helium were substituted for air in the barrel of the M110 SASS, then with its higher speed of sound of 1,007 m/s, the bullet would remain subsonic until it exited the muzzle-end of the barrel. Further, the decompressing Helium gas from the storage tank would also serve to cool the gun barrel as part of its purge function. Reduced barrel friction is another benefit.

Further, the density of Helium is about 0.1785 kg/m$^3$. As compared to a density of air of approximately 1.225 kg/m$^3$. So, Helium is about 15% of the density of air. As such, it puts up much less resistance to the travel of the bullet or projectile through it.

Finally, the release of a compressed purge gas into the barrel of a gun has a cooling effect. When a gas expands it cools under the pv=nRT noble gas law, where p is pressure, v in this case is volume, n is the number of moles of gas, R is the Boltzmann constant, and T is the temperature of the gas. Rearranging the terms and taking the ratio of two states produces the following ratio equation for the same number of gas molecules at different pressures and volumes:

$T_2/T_1 = p_2/p_1$, where

The temperature of the gas release to atmospheric pressure will depend on the ratio of the compressed gas temperature. Since $p_2$ is a much lower pressure than the stored pressure $p_1$ the resulting temperature $T_2$ will be lower than the starting temperature $T_1$ as determined by the ratio of the before and after pressures $p_2/p_1$. The gas released from its compressed storage container will be at a much lower temperature than the ambient temperature of the stored compressed gas. We have all experienced this when releasing the gas from a can or tank of compressed gasses, e.g., a compressed air tank.

Example 3: The Abrams Ml Main Battle Tank sports a 120 mm cannon. The L/55 version cannon dimensions are 120 millimeters in diameter (0.120 m or 4.72 in.) by 6.6 m (22 ft) in length. The volume of air sitting in the barrel (a right cylinder) is therefore $$\text{Vol.}=(\pi r^2)\cdot h, \text{ where}$$

The volume (Vol.) is equal to the constant pi ($\pi$=3.1415926) multiplied by the square of the radius of the barrel, times the height of that right cylinder.

$$\text{Vol.}=3.1415926\cdot(0.120/2)^2\cdot 6.6\text{ m}=0.075\text{ m}^3$$

Air has a density of approximately 1.225 kg/m. So, the air displaced by the projectile has a mass of approximately 0.1 kg. The M829 is an American armor-piercing, fin-stabilized, discarding sabot (APFSDS) tank round total weight is 18.6 kg using 8.1 kg of propellant, and a projectile mass of about 10 kg. So, the air displaced is about 1% of the weight of the projectile, including the discarded three-piece aluminum sabot.

The projectile muzzle velocity is between 1,580 to 1,750 m/s (5,200 to 5,700 ft/s), well above the speed of sound in air at 343 m/s. Assuming 1,580 m/s the projectile is traveling at MACH 4.6 as it exits the muzzle. If Helium were substituted for air in the L/55 version of the 120 mm cannon, then with its higher speed of sound of 1,007 m/s, the bullet would remain subsonic further up the barrel, reducing the time and distance in choked flow, and would exit the barrel at MACH 1.6, as it exited the muzzle-end of the barrel in Helium gas. Further, the decompressing Helium gas from the pressurized storage tank would also serve to cool the 120 mm cannon barrel as part of its purge and lubrication function.

Modeling

Flow inside a barrel 106 can be viewed as two separate moving gas flows. One flow, from the breech 124 end of the barrel 106, pushing from behind the projectile 104. Its movement is caused by the rapid expansion of pressurized gases from burning of the propellant, which accelerates the projectile 104 down the barrel 106 toward the muzzle 108. The other flow is located ahead of the projectile 104. This column of gasses is accelerated, and its movement is caused by the accelerating movement of the projectile 104, a solid impenetrable piston moving down the barrel. This rapidly accelerating projectile 104 pushes the internal air 112 in the barrel 106 before it, much like a piston, and depending on its speed, may also create a shock wave in the gas flow ahead of it at some point along the barrel. Even though there may be radial motion of the gas particles away from and toward the barrel centerline, either behind or ahead of the projectile 104, the net effect is negligible compared to effects of motion along the barrel 106 axis, which movement is axial. Thus, the flows may be assumed to be one dimensional, simplifying the modeling and analysis somewhat. Also, viscosity effects are comparatively small given that the fluids both behind and ahead of the projectile are gaseous. So, the ratio of viscous forces to inertial forces is fairly low, and both the diffusion and dissipation terms in the momentum and energy equations can be omitted without incurring too much error in the computed results.

The assumptions employed in modeling include the following conditions during the compression of the gases ahead of the projectile 104:

(1) the number of gas particles does not change locally, and (2) the forces between the gas particles are negligible.

The ideal gas assumption:

$$PV=nRT \quad [1]$$

also leads to writing the enthalpy (H in J/kg) and the speed-of-sound (a in m/s) equations in terms of pressure and density as:

$$H=(\gamma+1)/\gamma\cdot P/\rho, \text{ and} \quad [2]$$

$$a^2=\gamma\cdot P/\rho \quad [3]$$

Where $\gamma$ is the ratio of the terms $C_p$ and $C_v$ =(f+2)/f $C_v$ is the specific heat with constant volume (J/K-mol)

$C_p$ is the specific heat with constant pressure (J/kg-K)

f is the number of degrees of freedom (3 for monatomic gas, 5 for diatomic gas and collinear molecules.

P is pressure (in Pascals, Pa)

$\rho$ is density (in J/kg)

n is Avogadro's number ($6.023\times10^{23}$)

T is temperature (° K)

See some examples in TABLE 1 below

TABLE 1

| Gas Properties | | | | | | | | | | |
|---|---|---|---|---|---|---|---|---|---|---|
| Gas Name | Chemical Formula | Molecular Weight | $C_v$ in (J/K/m$^3$) | $C_p$ in (J/K/kg) | $\gamma$ | Density $\rho$ (kg/m$^3$) | Pressure (N/m$^2$) | Pressure (Pa) | f | (f + 2)/f |
| @3,00K, 1 ATM | | | | | | | | | | |
| Nitrogen | N2 | 32 | 743 | 1040 | 1.400 | 1.177 | 101325 | 1.0 | 5 | 1.40 |
| Air | N2 + O2 | 32.8 | 718 | 1006 | 1.402 | 1.177 | 101325 | 1.0 | 5 | 1.40 |
| Carbon Dioxide | CO2 | 44.0 | 657 | 846 | 1.288 | 1.788 | 101325 | 1.0 | 6.92 | 1.289 |
| Steam | H2O(v) | 44.0 | 1411 | 1872 | 1.327 | 0.732 | 101325 | 1.0 | 6 | 1.33 |
| Helium | He | 4 | 3118 | 5197 | 1.667 | 0.163 | 101325 | 1.0 | 3 | 1.67 |

TABLE 2

| Gas Properties | | | | | | | | | | |
|---|---|---|---|---|---|---|---|---|---|---|
| Gas Name | Chemical Formula | Molecular Weight | $C_v$ in (J/K/m$^3$) | $C_p$ in (J/K/kg) | $\gamma$ | Density $\rho$ (kg/m$^3$) | Pressure (N/m$^2$) | Pressure (Pa) | f | (f + 2)/f |
| @3,000K, 10 ATM | | | | | | | | | | |
| Nitrogen | N2 | 32 | 922 | 1223 | 1.327 | 1.177 | 1013250 | 10 | 5 | 1.40 |
| Air | N2 + O2 | 32.8 | 1376 | 1929 | 1.402 | 1.177 | 1013250 | 10 | 5 | 1.40 |
| Carbon Dioxide | CO2 | 44.0 | 1086 | 1276 | 1.175 | 1.788 | 1013250 | 10 | 6.92 | 1.289 |

TABLE 2-continued

| Gas Properties | | | | | | | | | | |
|---|---|---|---|---|---|---|---|---|---|---|
| Gas | Chemical | Molecular | $C_v$ in | $C_p$ in | | Density ρ | Pressure | | | |
| Name | Formula | Weight | (J/K/m$^3$) | (J/K/kg) | γ | (kg/m$^3$) | (N/m$^2$) | (Pa) | f | (f + 2)/f |
| Steam | H2O(v) | 18 | 1955 | 2594 | 1.327 | 0.732 | 1013250 | 10 | 6 | 1.33 |
| Helium | He | 4 | 3116 | 5193 | 1.667 | 0.163 | 1013250 | 10 | 3 | 1.67 |

TABLE 2

| Equations for Gun Barrel Interior Equations | |
|---|---|
| Speed of Sound | $a^2 = \gamma \cdot P/\rho$ |
| Start of Shock | $t_s = 2 \cdot a_s/(\gamma + 1)/\{\partial u_b/\partial t\}_{initial x=0}$ |
| Start of Shock | $x_s = a_s \cdot t_s$ |

NOTES:

γ is the ratio of the terms Cp and Cv = (f + 2)/f $C_v$ is the specific heat with constant volume (J/K-mol)

$C_p$ is the specific heat with constant pressure (J/kg-K)

f is the number of degrees of freedom (3 for monatomic gas, 5 for diatomic gas and collinear molecules.

P is pressure (in Pascals, Pa)

ρ is density (in kg/m$^3$)

a is the speed of sound (m/s)

$a_s$ is the speed of sound in the axial segment Δx (m/s), b is the axial speed of the bullet or projectile, and $t_s$ is the time to the start of formation of the shock wave (milliseconds)

$x_s$ is the axial location of the gas (m).

Shock Waves

The compressions converge and a shock forms at one point up the barrel ahead of the projectile. The coordinates at which the shock waves be in relative to the projectile's initial position may be obtained analytically as suggested by Gourant [_] and Corner [_] (see Table 2):

$$t_s = 2 \cdot a_s/(\gamma+1)/\{\partial u_b/\partial t\}_{initial\ x=0} \quad [_]$$

where:

$a_s$ is the speed of sound in the axial segment Δx (m/s), b is the axial speed of the bullet or projectile, and $x_s$ is the axial location of the shock initial position in the barrel (m).

and $x_s = a_s \cdot t_s$

The shock location, $x_s$, is found to be inside the barrel for these supersonic projectiles, then the shock equations (Rankine-Hugoniot) may be applied across the shock. When the shock is formed inside the barrel, it must be tracked through the flow field, and its location and properties determined at the points of intersection of the shock wave and the t-lines of an x-t graph.

The results of computing the start of the shock for the same propellant charge and projectile, but for different purge gases, shows that Helium delays the formation of the shock wave much longer than air or propellant reaction byproduct Carbon Dioxide. See Table 3 below.

TABLE 3

| Examples | | | | | | | | | |
|---|---|---|---|---|---|---|---|---|---|
| Shock Point Name | | Axial ($a_s$) Speed of | | Supersonic Flow $\{\partial u_b/\partial t\}_{x=0}$ | $t_s = 2 \cdot a_s/(\gamma + 1)/\{\partial u_b/\partial t\}_{x=0}$ | $x_s = a_s \cdot t_s$ | Start of Shock Formation | | |
| @3,000K, 10 ATM | Formula | Sound (m/s) | γ | m/s$^2$* | milliseconds | meters | % | ft. | Inches |
| | | | | Part 1 | | | | | |
| Nitrogen | N2 | 1,098 | 1.400 | 811 | 1.13 | 1.24 | 100% | 4.06 | 48.8 |
| Air | N2 + O2 | 1,098 | 1.400 | 811 | 1.13 | 1.24 | 100% | 4.06 | 48.8 |
| Carbon Dioxide | CO2 | 855 | 1.289 | 811 | 0.92 | 0.79 | 64% | 2.58 | 31.0 |
| Steam | H2O(v) | 1,355 | 1.327 | 811 | 1.44 | 1.95 | 157% | 6.39 | 76.7 |
| Helium | He | 3,222 | 1.667 | 811 | 2.98 | 9.60 | 775% | 31.51 | 378.1 |
| Shock Point Name | | Axial ($a_s$) Speed of | | Supersonic Flow $\{\partial u_b/\partial t\}_{x=0}$ | $t_s = 2 \cdot a_s/(\gamma + 1)/\{\partial u_b/\partial t\}_{x=0}$ | $x_s = a_s \cdot t_s$ | Start of Shock Formation | | |
| @3,000K, 10 ATM | Formula | Sound (m/s) | γ | m/s$^2$** | milliseconds | meters | % | ft. | Inches |
| | | | | Part 2 | | | | | |
| Nitrogen | N2 | 1,098 | 1.400 | 2000 | 0.46 | 0.50 | 100% | 1.65 | 19.8 |
| Air | N2 + O2 | 1,098 | 1.400 | 2000 | 0.46 | 0.50 | 100% | 1.65 | 19.8 |
| Carbon Dioxide | CO2 | 855 | 1.289 | 2000 | 0.37 | 0.32 | 64% | 1.05 | 12.6 |
| Steam | H2O(v) | 1,355 | 1.327 | 2000 | 0.58 | 0.79 | 157% | 2.59 | 31.1 |
| Helium | He | 3,222 | 1.667 | 2000 | 1.21 | 3.89 | 775% | 12.78 | 153.3 |

NOTES:

*Projectile muzzle velocity MACH 1.8

**Projectile muzzle velocity MACH 4

Figure 2:
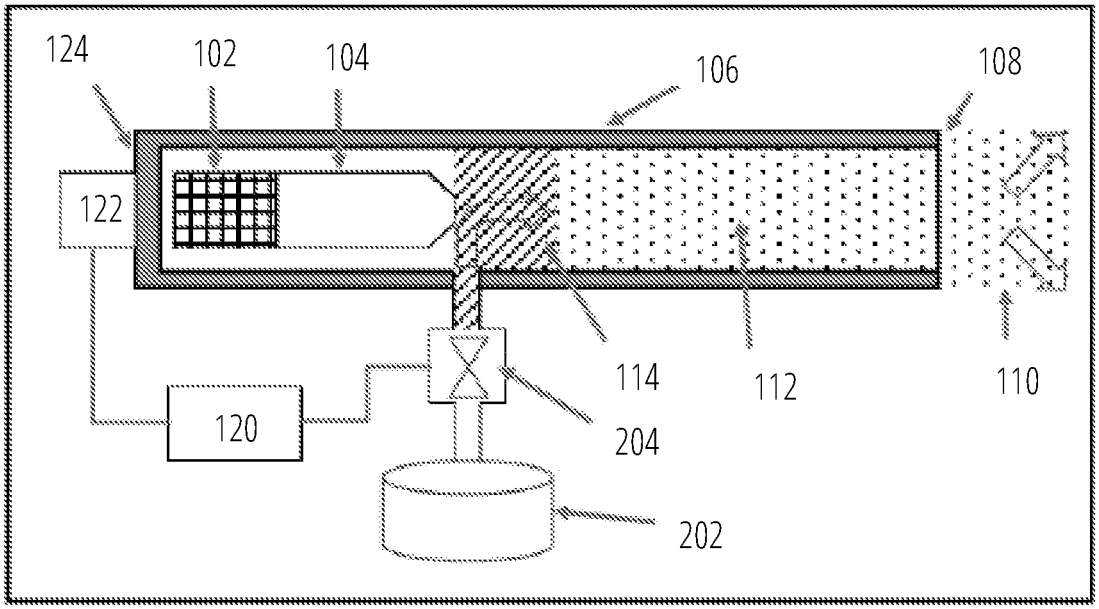
FIG. 2 is a cutaway sideview representation of a purge gas apparatus according to an embodiment of the present application.

Referring now to FIG. 2, the system comprises a charge 102, a projectile 104, a barrel 106, a muzzle 108, an exit air 110, an internal air 112, a purge gas 114, a trigger 120, a firing mechanism 122, a breech 124, a water tank 202, and a steam flash 204.

Here, as opposed to FIG. 1, there is a water tank 202 and a steam flash 204. Thus, the purge gas system has been replaced with a steam system. All other components of this embodiment are substantially the same and operate under the same principles as that described in FIG. 1.

The water tank 202 as suggested contains a volume of water to be used in the purge process. The water tank 202 is in fluid connection with a steam flash 204. The steam flash 204 may be any structure capable of quickly heating water (flash) to its boiling point thereby generating steam. The steam may be introduced in a constant stream or may be generated and dispersed into the barrel 106 by a valve or upon user preference, thereby replacing the internal air 112 within the barrel 106.

Figure 3:
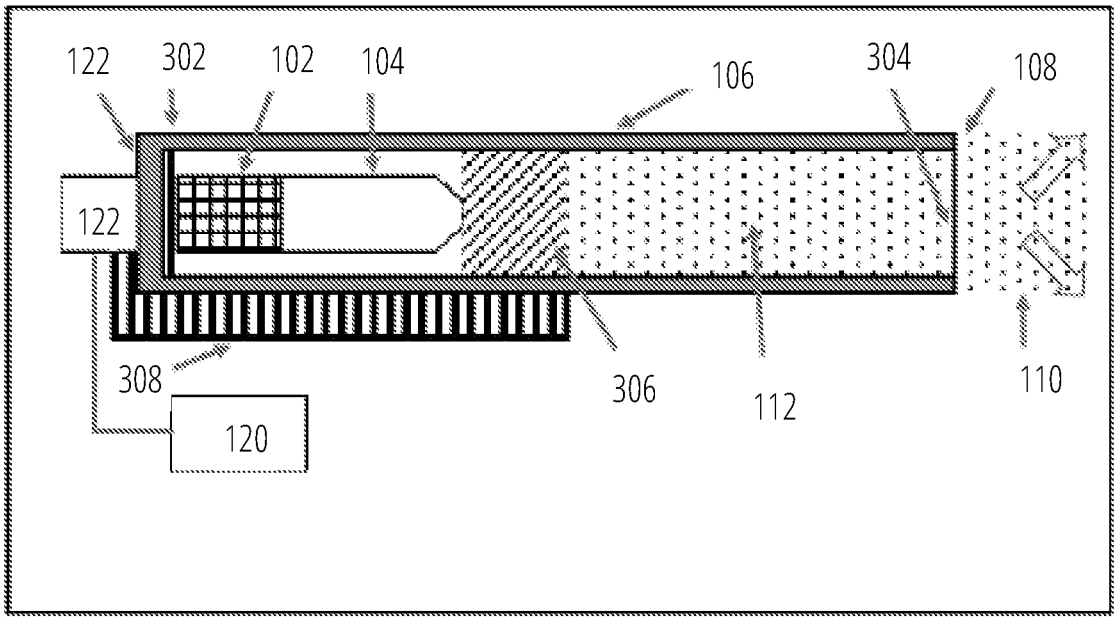
FIG. 3 is a cutaway sideview representation of a steam gas apparatus according to an embodiment of the present application.

Referring now to FIG. 3, the system comprises a charge 102, a projectile 104, a barrel 106, a muzzle 108, an exit air 110, an internal air 112, a trigger 120, a firing mechanism 122, a breech firm seal 302, a muzzle foil 304, a compression wave 306, and a barrel holder 308.

Here, there is pre-purged barrel 106 which includes a breech firm seal 302 and muzzle foil 304. Thus, there is no external purge apparatus as shown in FIGS. 1 and 2, as the barrel 106 is a "self-contained" pre-purged apparatus. The barrel 106 may be coupled to an existing firing apparatus such as a firing mechanism 122 and trigger 120 or may have such components already coupled thereto.

The breech firm seal 302 and the muzzle foil 304 may be of the same or a different construct. The muzzle foil 304 is preferably a foil or other membrane of sufficient strength and adhesion to be fit over the end of the barrel 106 at a muzzle 108 end of the barrel 106. The muzzle foil 304 may be configured to burst or rupture along a predetermined path or pattern based on a construct of the muzzle foil 304.

The muzzle foil 304 prevents any external air from entering the barrel 106. The internal air 112 of the barrel 106 in such an embodiment may be of a vacuum or may comprise a purge gas in accordance with the embodiments of the present application as described herein.

Further the breech firm seal 302 acts in a similar manner at the breech 124 end of the barrel 106. The breech firm seal 302 may be pierced by the firing mechanism 122 as the firing mechanism 122 makes contact with the charge 102 of the projectile 104. Such a piercing fractions of a second before firing of the projectile 104 does not allow for sufficient atmosphere to enter the barrel 106 prior to the charge 102 being ignited thereby expelling the projectile 104 from the barrel 106.

Figure 4:
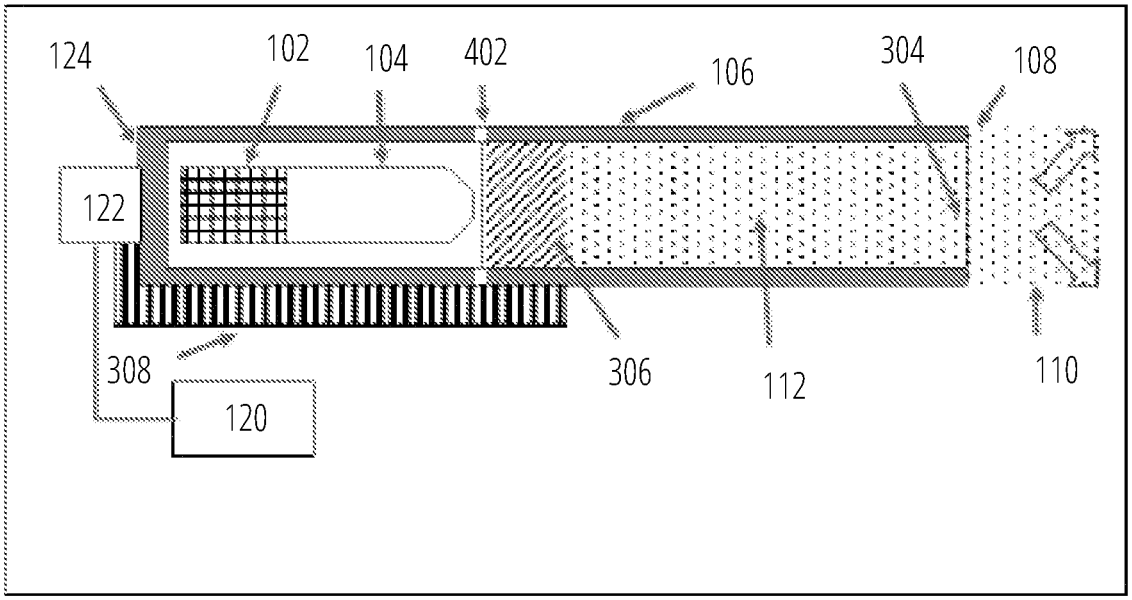
FIG. 4 is a cutaway sideview representation of a pre-purged barrel according to an embodiment of the present application.

Referring now to FIG. 4, the system comprises a charge 102, a projectile 104, a barrel 106, a muzzle 108, an exit air 110, an internal air 112, a trigger 120, a firing mechanism 122, a breech 124, a muzzle foil 304, a compression wave 306, a barrel holder 308, and a breech seal 402.

Here, there is another pre-purged barrel 106 which includes a breech seal 402. As opposed to the embodiment shown in FIG. 3, the breech seal 402 has been positioned in front of the projectile 104. The muzzle foil 304 is also present on this embodiment. This creates a separation between the projectile 104 and the remaining interior of the barrel 106.

In yet another embodiment, there may be a gas shell associated with the present invention. The gas shell may come in one of two basic forms: 1) a separate Gas-only shell (GOS) as shown in FIG. 5; and 2) the Gas-incorporated shell (GIS) as shown in FIG. 6.

Figure 5:
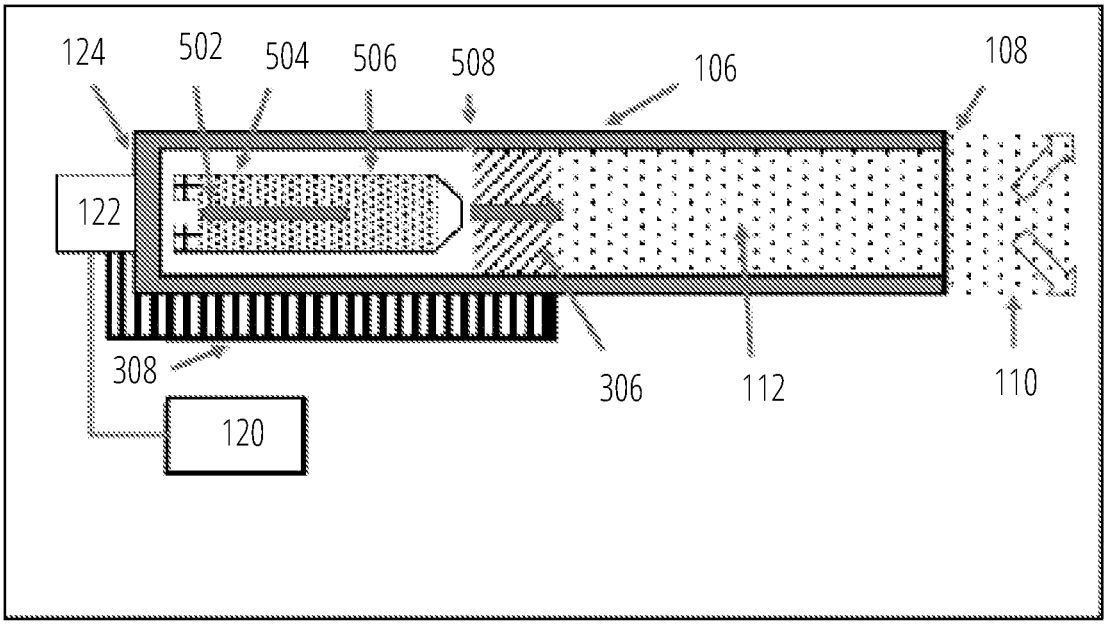
FIG. 5 is cutaway sideview representation of a gas-only shell (GOS) according to an embodiment of the present application.

Referring now to FIG. 5, the system comprises a barrel 106, a muzzle 108, an exit air 110, an internal air 112, a trigger 120, a firing mechanism 122, a breech 124, a compression wave 306, a barrel holder 308, a gas exiting GOS 502, a valve 504, a gas filled bottle 506, and a tip of GOS 508.

The GOS is a separate shell primarily containing the desired compressed gas or mixture. It contains no munitions explosive. Its purpose is to purge the barrel 106 of internal air 112 and to replace them with a separate desired special gas or mixture. It may contain a small charge to open the compressed gas container and/or propellant to propel it out the muzzle 108 of the barrel 106. When activated by valve 504 or by charge, the compressed gas or mixture is ejected from the base of the GOS 502 propelling it out the muzzle 108 of the barrel 106, thereby ejecting the prior barrel gaseous contents, e.g., propellant gases, while filling the barrel 106 with the desired replacement gas or mixture. The spent non-explosive GOS falls harmlessly downrange. The munition is then loaded and fired through the barrel 106 filled with the replacement gas or mixture, having the desired effect.

Figure 6:
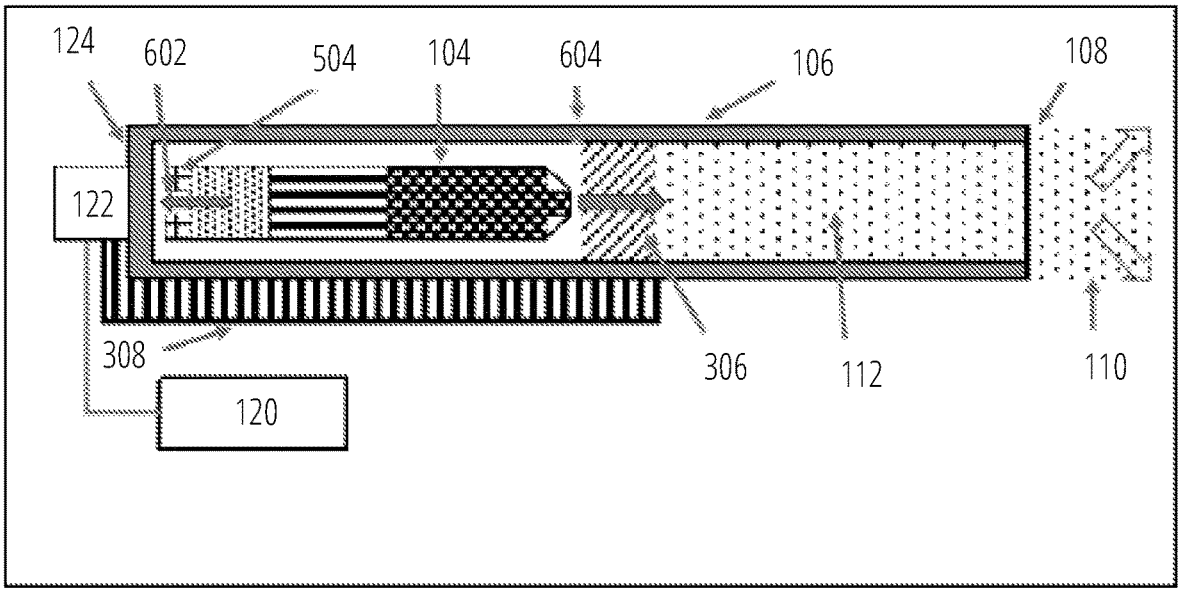
FIG. 6 is a cutaway sideview representation of a gas-incorporated shell (GIS) according to an embodiment of the present application.

Referring now to FIG. 6, the system comprises a projectile 104, a barrel 106, a muzzle 108, an exit air 110, an internal air 112, a trigger 120, a firing mechanism 122, a breech 124, a compression wave 306, a barrel holder 308, a valve 504, a gas exiting GIS 602, and a tip of GIS 604.

The GIS contains a compressed gas reservoir at the breach end of the gun behind the munition. When the propellant is activated, the sabot or explosive projectile 104 is ejected from the muzzle 108 of the gun barrel 106. The compressed gas container remains behind with the shell casing and opens to purge the barrel 106 of the propellant gases, ejecting them out the muzzle 108 of the barrel 106, and replacing them with the preferred gas or mixture. The shell casing and compressed gas tank are then ejected from the breech 124 end of the barrel 106. And the next GIS is loaded into the breach.

The same principles apply to the replacement gas or mixture. Its characteristics benefit the firing of the next munition. Those benefits may include lubrication, cooling and/or a higher speed of sound.

Although this invention and its embodiments have been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An apparatus for use for launching a projectile comprising:

a trigger coupled to a firing mechanism;

a breech for loading the projectile, wherein the projectile has a propulsive charge and projectile body, a barrel having a breech end and a muzzle end;

and a purge apparatus configured to purge air and other gasses from an interior of the barrel thereby displacing and replacing the air and other gases with a purge gas, wherein the purge apparatus is activated before the launching of the projectile.

2. The apparatus of claim 1 wherein the purge gas is at least one of helium, hydrogen, methane, or any combination thereof.

3. The apparatus of claim 1 wherein the purge gas has a lower density and a higher speed of sound than the air.

4. The apparatus of claim 1 wherein, when the trigger of the apparatus is activated, a valve releases the purge gas into an interior of the barrel.

5. The apparatus of claim 1 further comprising a vessel configured to store a fluid.

6. The apparatus of claim 5 wherein the fluid is water.

7. The apparatus of claim 6 wherein the water is converted to steam, and the steam is used to purge the air and other gases from the barrel.

8. The apparatus of claim 1 further comprising a membrane disposed over an opening of the barrel.

9. The apparatus of claim 1 wherein the purge gas fully purges the interior of the barrel.

10. The apparatus of claim 1 wherein the purge gas partially purges the interior of the barrel.

11. The apparatus of claim 1 wherein the purge gas is methane in combination with at least one of hydrogen and helium.

12. The apparatus of claim 1 wherein when projectile is configured to travel at a subsonic speed along an entire length of the barrel.

13. The apparatus of claim 1 further comprising a first membrane positioned to cover an opening of the muzzle end of the barrel and a second membrane positioned between the first membrane and the projectile when the projectile is loaded into the barrel.

14. The apparatus of claim 1 further comprising a rupturable gas reservoir located proximate to the projectile and being configured to rupture and purge the barrel of propellant by-product gases upon firing of the projectile.

15. An apparatus for use for launching a projectile comprising:

a trigger coupled to a firing mechanism;

a breech for loading the projectile, with the breech holding h projectile, a barrel having a breech end and a muzzle end, wherein the projectile is configured to be expelled from the barrel;

a membrane disposed over and adhered to an opening of the muzzle end of the barrel; and a purge apparatus configured to purge air and other gasses from an interior of the barrel thereby displacing and replacing the air and other gases with a purge gas, wherein the purge apparatus is activated before the expelling of the projectile.

16. The apparatus of claim 15 wherein the membrane is a rupturable foil configured to rupture along a predetermined path or pattern.

17. An apparatus for use for launching a projectile comprising:

a trigger coupled to a firing mechanism;

a breech for loading the projectile, wherein the projectile has a propulsive charge and projectile body, a barrel having a breech end and a muzzle end;

a membrane configured to seal the barrel; and a purge apparatus configured to purge air and other gasses from an interior of the barrel thereby displacing and replacing the air and other gases with a purge gas, wherein the purge apparatus is activated before the launching of the projectile.

18. The apparatus of claim 17 wherein the membrane covers an opening of the barrel.

19. The apparatus of claim 17 wherein the membrane is positioned between the breech end and the muzzle end of the barrel.

20. The apparatus of claim 19 wherein the membrane is positioned between the breech end of the barrel and the projectile when the projectile is loaded into the barrel.

* * * * *